US005720517A

United States Patent [19]

Prothro, Sr.

[11] Patent Number: 5,720,517

[45] Date of Patent: Feb. 24, 1998

[54] ADJUSTABLE WORK CHAIR

[76] Inventor: Hassell Drew Prothro, Sr., P.O. Box 699, Haughton, La. 71037

[21] Appl. No.: 661,735

[22] Filed: Jun. 11, 1996

[51] Int. Cl.[6] ..... A47C 4/22

[52] U.S. Cl. ..... 297/195.11; 297/19; 297/423.12; 297/451.3

[58] Field of Search ..... 297/19, 16.1, 31, 297/56, 195.11, 423.11, 423.12, 423.13, 451.3

[56] References Cited

U.S. PATENT DOCUMENTS

| | | | |
|---|---|---|---|
| 4,589,699 | 5/1986 | Dungan . | |
| 4,614,378 | 9/1986 | Picou | 297/423.13 X |
| 4,650,249 | 3/1987 | Serber . | |
| 4,765,684 | 8/1988 | Kvalheim et al. . | |
| 5,054,857 | 10/1991 | Kvalheim . | |
| 5,186,519 | 2/1993 | Larson | 297/423.12 X |
| 5,401,078 | 3/1995 | Riach | 297/423.11 |
| 5,490,716 | 2/1996 | Naughton . | |

FOREIGN PATENT DOCUMENTS

| | | | |
|---|---|---|---|
| 88/00016 | 1/1988 | WIPO | 297/423.12 |

*Primary Examiner*—Peter R. Brown
*Attorney, Agent, or Firm*—Longacre & White

[57] ABSTRACT

An adjustable work chair comprising a frame, a seat support structure, and a versatile seat combination. The adjustable work chair has a seat support structure which allows alterations to the seat's height and orientation. Furthermore, the adjustable work chair may be mobile through alternative embodiments using hinged castors, may provide knee support through alternative embodiments including knee pads, or may have a tray for holding instruments, parts, tools, or other equipment. The adjustable work chair provides a comfortable platform that allows the operator to efficiently perform tasks over a prolonged time frame. Additionally, embodiments of the adjustable work chair provides a platform which allows the operator to alter the seat's height, location, or orientation to provide a wide range of positions ranging from a seating position to a creeper position.

26 Claims, 4 Drawing Sheets

ADJUSTABLE WORK CHAIR

BACKGROUND OF THE INVENTION a) Field of the Invention

This invention pertains to an adjustable work chair that allows the worker to remain continuously seated, properly oriented in the work area and comfortably positioned in the chair.

b) Description of Related Art

There are numerous situations where a seated worker must focus on a work area for an extended period of time. Significant physical problems may arise from such a work environment. For example, seated workers may experience symptoms ranging from soreness to severe lower back problems when their employment requires them to remain seated in a fixed position for an extended period of time. A worker's efficiency is reduced when he suffers from discomfort, soreness, or cramping caused by poor body position. Moreover, poor body position can lead to permanent medical problems.

A work chair that allows the worker to remain continuously seated, properly oriented on the work area, and comfortably positioned in the chair will increase productivity and reduce the risk of work-related injury. Automobile detailers, computer programmers, car mechanics, factory workers, repairmen, and surgeons are but a few of the potential users of an adjustable work chair. There have been attempts to produce such a work chair that eliminates the aforementioned problems. However, the need exists for a simple, inexpensive, and effective chair that allows the user to adjust the chair's orientation. Moreover, a chair that is mobile and allows the user to adjust the seat between a seated and seated-kneeling position amounts to an improvement in the art. Finally, a chair which is collapsible and portable is also an improvement.

SUMMARY OF THE INVENTION

The present invention is an adjustable work chair comprising a T-shaped base, a seat, and a seat support structure that allows the User to adjust the orientation of the work chair to suit the user. The user may select from a conventional seated position, a forward leaning position which includes a chest pad, and a combination seated-kneeling position which studies have shown to be an preferable position over extended periods of time. The adjustable work chair provides these multiple positions through a versatile attachment means which allows the seat and seat support structure to be adjusted independent of one another. Additionally, alternative embodiments of the present invention include hinged castors for mobility, a gas shock for improved adjustability, and a work tray to provide ready access to instruments or tools. Embodiments of the present invention provide an adjustable work chair that provides the user with increased mobility and portability. The present invention permits the user to select and adjust the chair's height and orientation. The present invention is simple to construct and easy to manufacture.

The present invention thus provides a work chair having a versatility to convert from a flat platform that supports a worker who is laying low to the ground to a seated arrangement that can be adjusted to accommodate numerous environments.

The present invention comprises an T-shaped base for simple construction and improved stability. The T-shaped base includes a first length on the long axis and a second length on the transverse axis of the base. The length of the long axis is preferably greater than the length of the transverse axis. The T-shaped base may be in contact with the ground, or it may include hinged castors to provide mobility. Further, the T-shaped base may have hinged castors which are depressed such that the T-shaped base is situated in close proximity to the ground and suited for a wide range of terrains and surfaces. This configuration allows mobility yet keeps the chair's center of gravity at the lowest possible point.

In addition, the gas shock design allows the entire work chair to be collapsed. While the simple construction of the invention makes it portable, the gas shock makes it even more portable.

The work chair of this invention can be fitted with a variety of seats, seating fixtures and seating attachments. For example, a chest attachment would allow the user to relax in the forward leaning position. Fixtures and trays could be mounted to the work chair to make tools and equipment accessible to the user.

An improved seat design provided by this invention would permit the user to convert this work chair from a kneeling position to a creeper position (with the worker lying flat) and further to a seated position. This design is a substantially improvement of the prior art, and is particularly useful in the automotive industry where workers are required to assume numerous working positions.

These and other advantages of this invention will become apparent with reference to the drawings and description to follow.

DETAILED DESCRIPTION OF THE INVENTION

Figure 1:
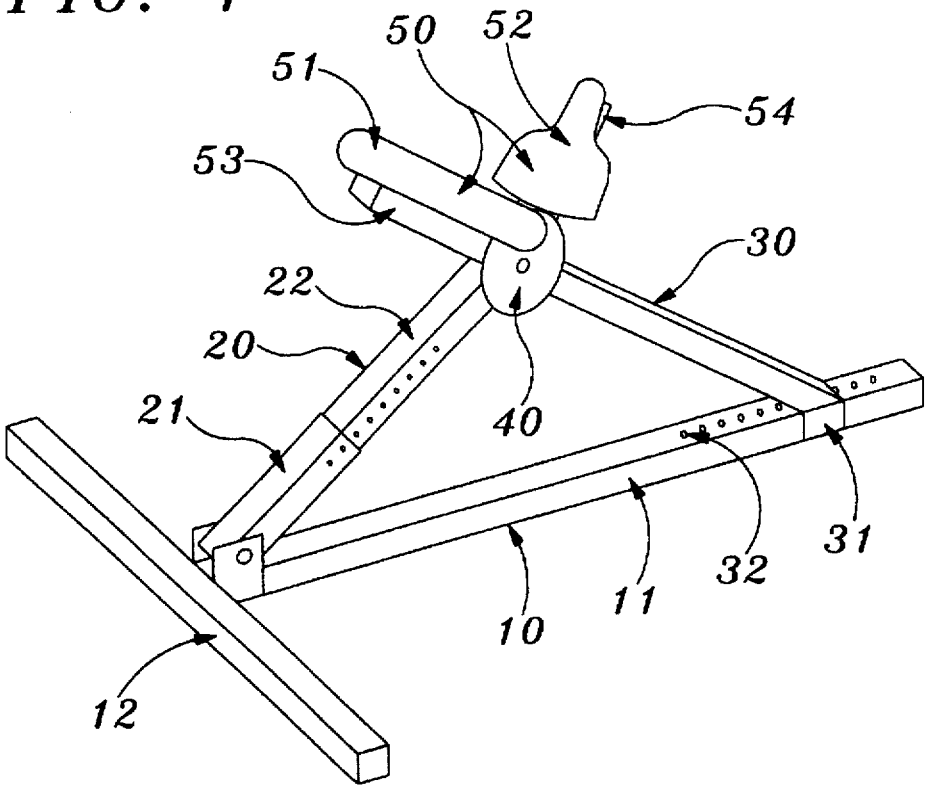
FIG. 1 is a perspective view of the invention with a two piece seat.

In accordance with the present invention, an adjustable work chair is provided which comprises a base, a support structure, and a seat structure. FIG. I depicts the present invention with a two piece seat (50). A T-shaped base (10) provides a stable foundation. The T-shaped base consists of a first length (11) comprising the long axis and a second length (12) attached to an end of the first length (11) and oriented along the transverse axis of the T-shaped base (10).

A first arm (21) is attached at the intersection between the first length (11) and the second length (12) of the T-shaped base (10). The first arm (21) is cantilevered and telescopes (22) to extend down the long axis of the base at an acute angle to the first length (11) of the T-shaped base (10). An end of the first arm (20) is attached to an attaching means (40) for coupling the first arm (20) to a seat (50) and a second arm (30).

A second arm (30) is variably attached (31) to the first length (11) of the T-shaped base (10) such that it may be fixed to the first length (10) a any one of a number of positions (32). The first arm (20) and the second arm (30) are used in conjunction to orient the seat (50). The seat (50) comprises two pieces. The first piece is a pad (51) attached at an angle to the attachment means (40) by a stem (53). The second piece which is a pad (52) attached to the attachment means (40) by a second stem (54). The seat (50) is attached to the attachment means such that the seat (50) having pieces (51,52) may be independently adjusted.

Figure 2:
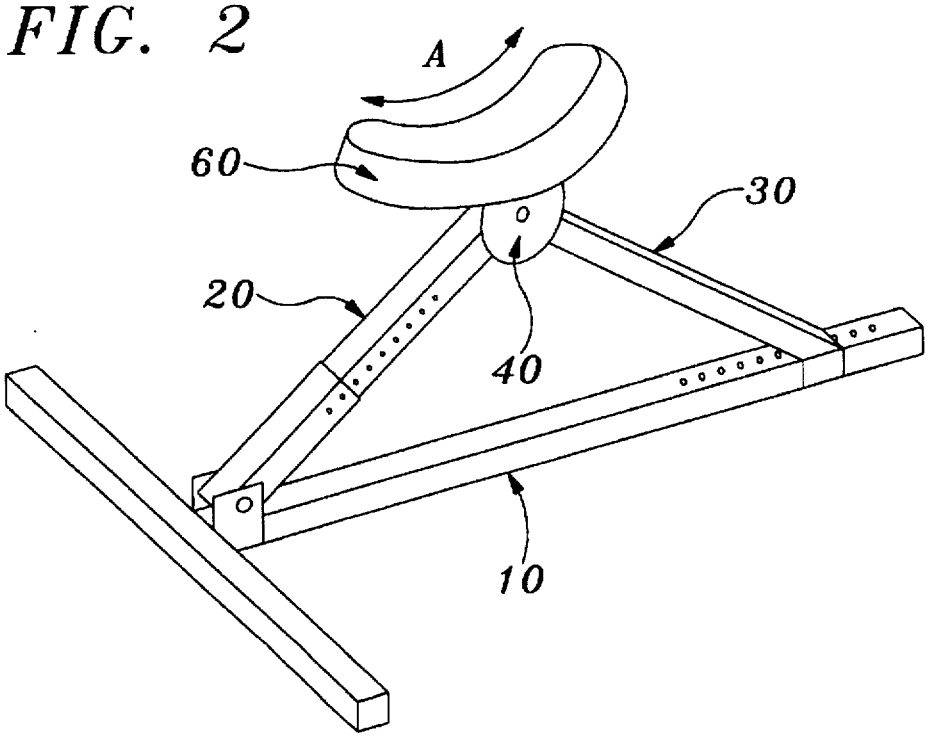
FIG. 2 is a perspective view of the invention with a pivoting seat.

The invention may also comprise a single-piece, pivoting seat (60). As shown in FIG. 2, the seat (60) comprises one piece member which slides along its own length. FIG. 2 shows such an adjustable seat where one pad (60) is attached to the attaching means (40) such that a detent, screw or similar means of sliding the pad (not shown) may be released or loosened to allow the user to adjust the work chair. The seat (60) rotates about the transverse axis of the work chair in relation to the long axis of the T-shaped base (A). In the preferred embodiment, the seat (60) banana-like in shape and slides along an arc to a variety of positions relative to the attaching means 40. The embodiment shown in FIG. 2 comprises the first arm (20) and the second arm (30) which are similarly attached to the attachment means (40). However, other embodiments of the present invention may similarly utilize the one-piece seat (60).

Figure 3:
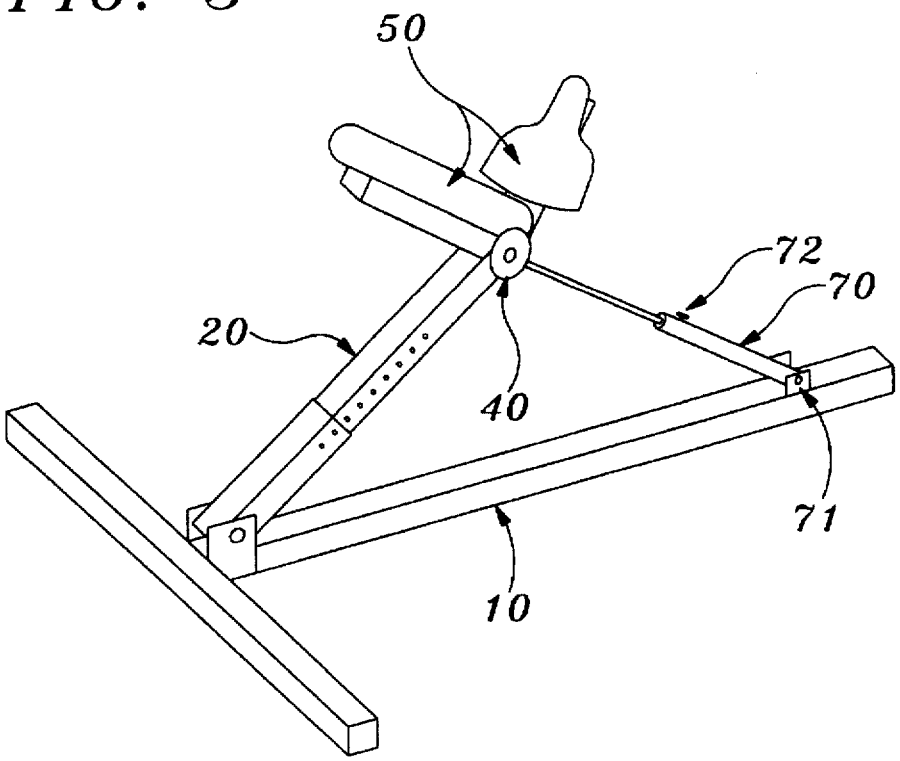
FIG. 3 is a perspective view of the invention with a gas shock.

In another embodiment of the invention shown in FIG. 3, the second arm (30) is replaced by a positively pressured gas shock (70). The gas shock (70) is attached at a point along the long axis of the T-shaped base (71). Additionally, the gas shock (70) is cantilevered and oriented up the long axis of the T-shaped base (10) such that is extends up at an acute angle from the base, intersecting the attaching means (40). The gas shock (70) provides an adjustment means (72) whereby the user may extend or compress the seat with only a release of the adjustment means (72) and either a slight increase or decrease in weight applied onto the seat (50) by the user. Therefore, the gas shock (70) allows the user to adjust the seat (50) without standing up. The gas shock (70) may be utilized with both the one piece (60) and the two piece seats (50).

Figure 4:
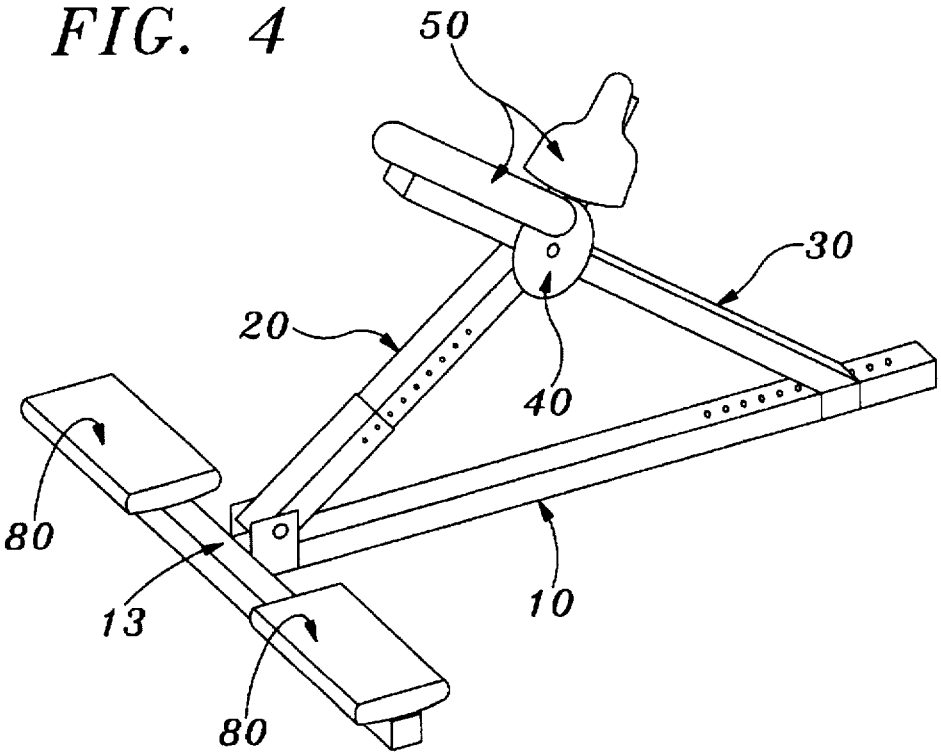
FIG. 4 is a perspective view of the invention with a knee-pad.
Figure 5:
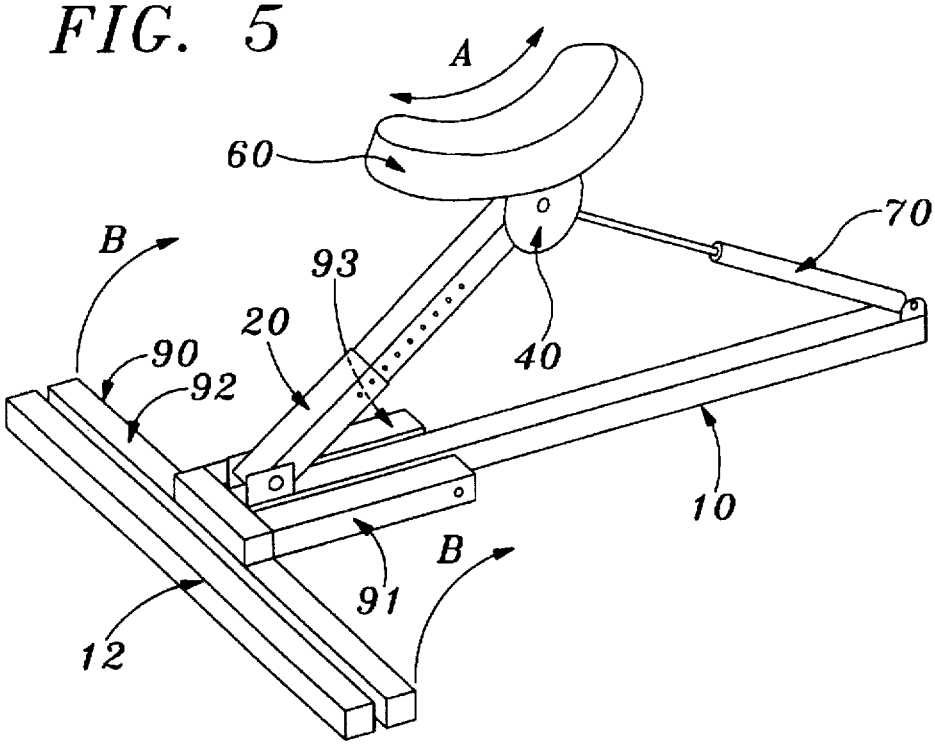
FIG. 5 is a perspective view of the invention with an adjustable knee pad.

In still another embodiment of the invention shown in FIG. 4, a knee pad (80) may be added to the invention to permit a user to assume a hybrid sitting-kneeling position. While two knee pads (80) are depicted in FIG. 4, one of ordinary skill in the art would see that there are other embodiments which include one or more knee pads (80) on an upper surface (13) of the transverse portion (12) of the T-shaped base (10). Furthermore, FIG. 5 shows an embodiment of the invention with an adjustable knee pad (90). The adjustable knee pad (90) comprises at least one arm (91) which is attached to the long portion (11) of the T-shaped base (10). The at least one arm (91) extends upward toward the transverse portion (12) of the T-shaped base (10). A transverse portion (92) is attached to the at least one arm (91) at an end of the at least one arm (91). The transverse portion (92) of the at least one arm (91) is parallel to the transverse portion (12) of the T-shaped base (10), and the transverse portion (92) of the at least one arm (91) has at least one pad (not shown) on an upper surface (13) of the transverse portion (92) of the at least one arm (91). The at least one arm (91) is adjustable such that the transverse portion (92) of the at least one arm (91) may be elevated above the T-shaped base (10). A second arm (93) is shown in this symmetrical embodiment (FIG. 5), though one of ordinary skill of the art could other obvious alternative arrangements. Additionally, the two-piece seat (50) or the second arm (50) could be used in conjunction with the adjustable knee pad (90) as well.

Figure 6:
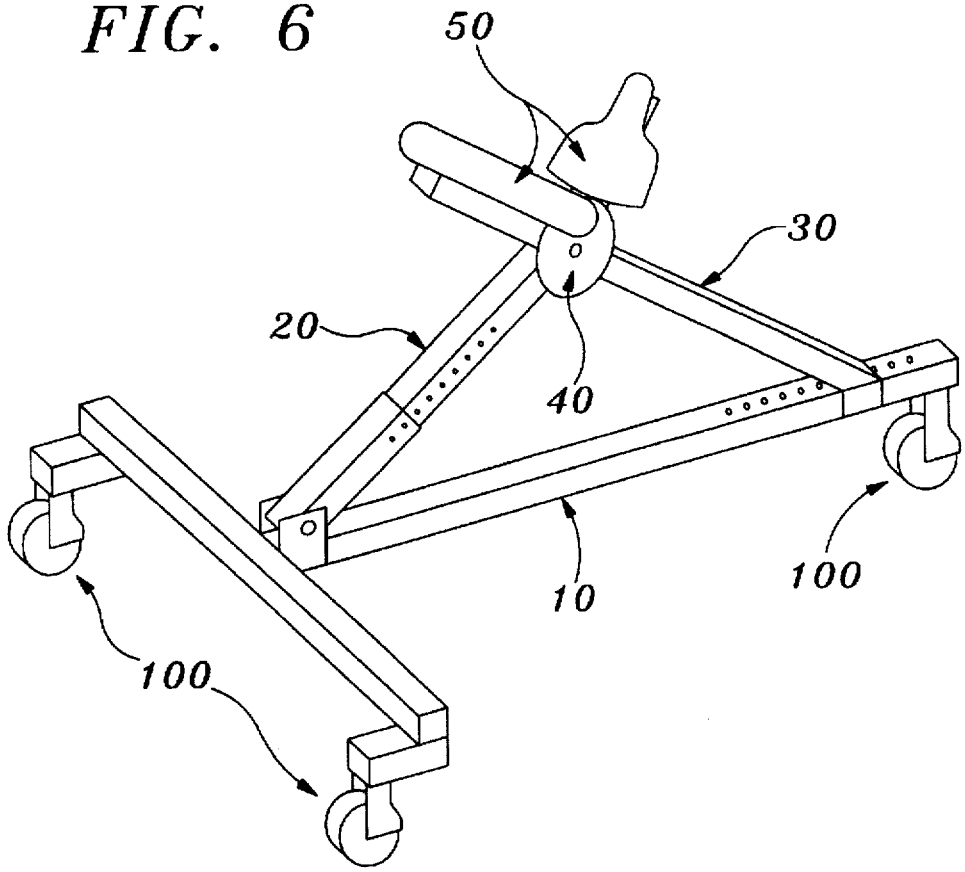
FIG. 6 is a perspective view of the invention with swiveled castors.

The base (10) may further include swiveled castors (100) to provide mobility as depicted in FIG. 6. In the present embodiment, the castors (100) are located at the corners of the T-shaped base, but one of ordinary skill in the art may find other obvious configurations. Each castor is located on a lower surface of the base (not shown) to allow directional movement of the adjustable work chair. It should also be understood that the castors (100) may be design for use on a variety of terrains and surfaces. Such castors (100) may be used in any of the embodiments of the invention.

Figure 7:
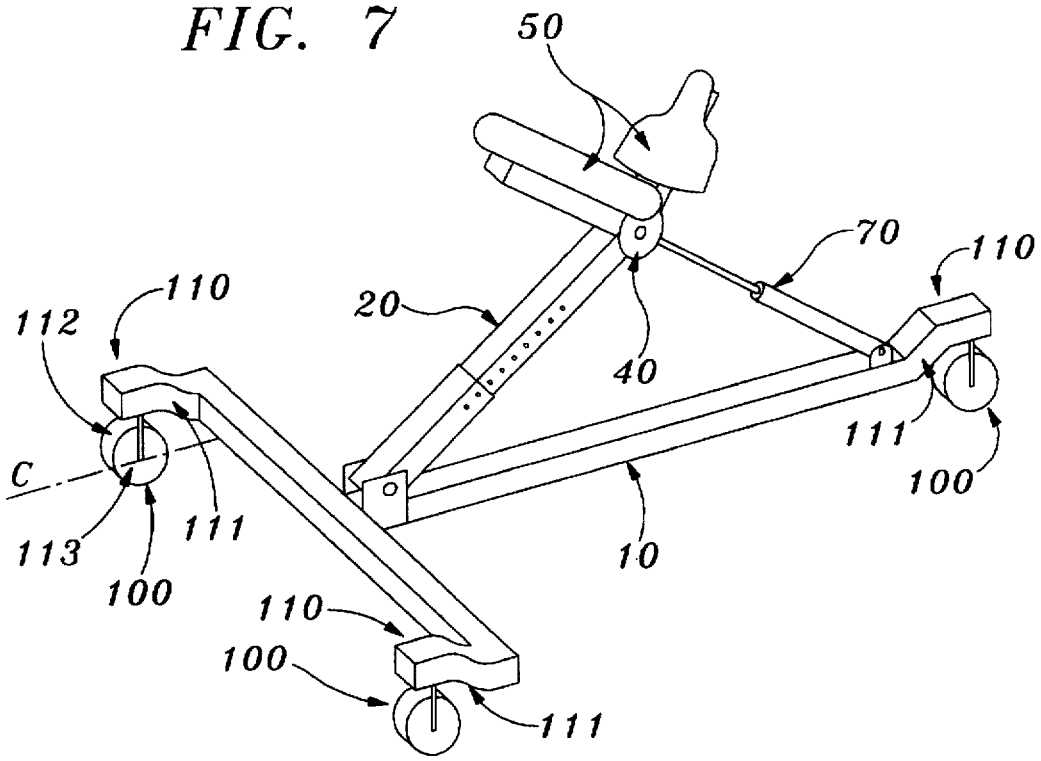
FIG. 7 is a perspective view of the invention with an offset version of the swiveled castors.

Furthermore, the castors (100) may be offset (110), lowering the base (10) closer to the ground in FIG. 7 than the original castors (100) in FIG. 6. The offset (110) is accomplished by using a T-shaped base (10) having elbows (111) at each corner of the base (10), so the swiveled castors may be placed so that a large portion of the castor (112) is oriented above the T-shaped base (10) along the plane (C) formed by the lower surface (not shown) of the base (10). Only a nominal portion of the castor (110) extends below the frame (113), so the base (10) is lower to the ground. The offset (110) may also be used with any of the embodiments of the invention.

Figure 8:
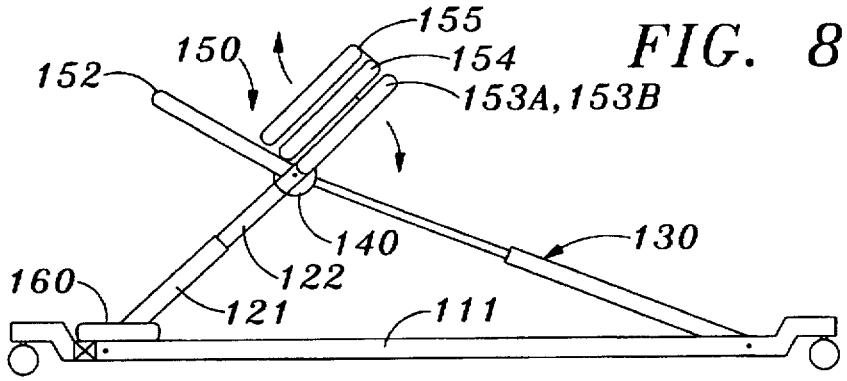
FIG. 8 is a side view of the invention having a seating/creeper arrangement with the invention shown in the seating position.
Figure 9:
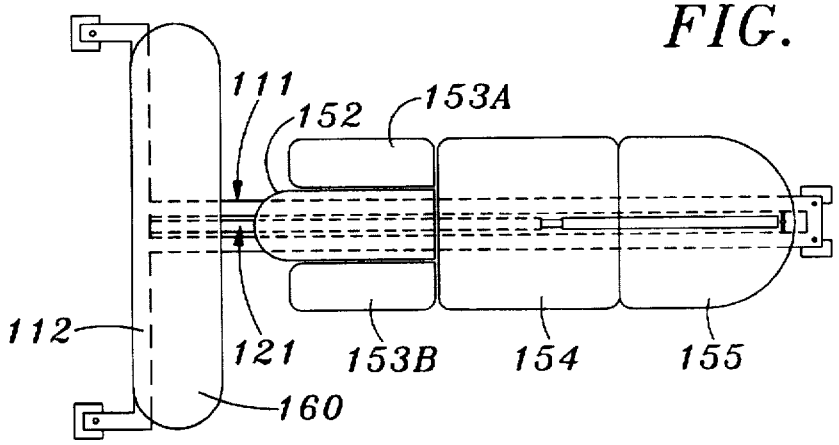
FIG. 9 is a top view of the invention having a seating/creeper arrangement with the invention shown in the creeper position.

FIGS. 8 and 9 depict a further preferred embodiment of this invention. The embodiment of FIGS. 8 and 9 provides enhanced versatility which enables the user to adjust the work chair between three positions; the creeper position wherein the user lays flat in relation to the ground, the kneeling position, and the seated position. The design of FIGS. 8 and 9 increases the number of useful positions to enable the user to perform a task in the most comfortable and safe position.

The following description will focus on the elements of this embodiment that differ from the previous embodiments. The distinguishing feature of the embodiment of FIGS. 8 and 9 centers around the design of the seating/creeping member which unfolds of expands from an upright seating to a flat creeper platform. In the flat creeper position, the work chair assumes a relatively flat position and has all of the utility and benefits of a conventional creeper.

A T-shaped base is once again utilized to provide a stable foundation. The T-shaped base consists of a first length (111) comprising the long axis and a second length (112) attached to an end of the first length (111) and oriented along the transverse axis of the T-shaped base. It should be noted that the first length (111) of this embodiment may require increased support strength, for example, two parallel lengths may be used to form the first length (111) as illustrated in FIG. 9. Moreover, more than one castor may be provided at the end of the first length (111) for improved support and stability.

A kneeling cushion (160) may be suitable provide adjacent the second length (112) as described in the foregoing embodiments.

A first arm (121) is attached at the intersection between the first length (111) and the second length (112) of the T-shaped base. The first arm (121) is cantilevered and comprises telescoping member (122) to extend down the long axis of the base at an acute angle to the first length (111) of the T-shaped base. An end of the first arm (121) is attached to an attaching means (140) for coupling the first arm (121) to a seat member (150) and a second arm (130).

The second arm (130) is variably attached to the first length (111) of the T-shaped base such that it may be either fixed to the first length (111) a any one of a number of positions as described with respect to FIG. 1, or may comprises a piston-cylinder arrangement as described with respect to FIG. 3. The first arm (121) and the second arm (130) are used in conjunction to orient the seat (150).

The seat (150) comprises a first main cushion member (152) and a second main cushion member (154). The first and second main cushion members (152, 154) may assume different positions relative to one another depending, for example, on the orientation of the first arm (111) and second arm (130). Significantly, the second main cushion member (154) further comprises auxiliary pads (153*a*, 153*b*, 155). The auxiliary pads (153*a*, 153*b*, 155) are pivotally connected to the second main cushion member (154) and are adapted to unfold to form a creeper surface as illustrated by FIG. 9. It should be understood that the auxiliary pads may be designed in any suitable manner to expand into this creeper surface. For example, the auxiliary pads may slide relative to the second main cushion member (154) or may be formed as telescoping members which telescope out of the second main cushion member (154). In any event, the embodiment of FIGS. 8 and 9 provides a novel work chair having multiple positions ranging from an upright seating position to a flat creeper position.

While the foregoing invention has been shown and described with reference to several preferred embodiments, it will be understood by those possessing skill in the art that various changes in form and detail may be made without departing from the spirit and scope of this invention.

I claim:

1. An adjustable work chair comprising:

a T-shaped base;

a first arm pivotally attached to said T-shaped base at an intersection between a long and transverse length of said T-shaped base; said first arm being cantilevered with respect to said T-shaped base such that said first arm may be elevated above said T-shaped base;

a second arm adjustably attached to said T-shaped Base on said long length distant from said intersection, said second arm extending above said T-shaped base and intersecting with said first arm along a length of said first arm at an intersection point above said T-shaped base;

an attachment means for connecting said first arm and said second arm above the T-shaped base; and a seat attached to said attachment means including at least one pad which is adjustably oriented relative to said T-shaped base wherein, said first arm comprises a telescoping member to adjust said length of said first arm.

2. The adjustable work chair in claim 1, wherein said second arm comprises a gas shock attached to said T-shaped base at a location along the long axis of said T-shaped base; said gas shock being cantilevered on said T-shaped base and adapted to adjust the relative position of said intersection point with respect to said T-shaped base.

3. The adjustable work chair in claim 1, wherein said T-shaped base further comprises at least one swivel castor on a lower surface of said T-shaped base.

4. The adjustable work chair in claim 3, wherein said at least one swivel castor is attached to said T-shaped base at an offset such that said T-shaped base is below the upper surface of said at least one swivel castor.

5. The adjustable work chair in claim 1, wherein said adjustable work chair further comprises a tray adapted to hold tools and equipment; said tray being removably attached to the transverse portion of said T-shaped base.

6. The adjustable work chair in claim 1, wherein said seat pivots with respect to said base.

7. The adjustable work chair in claim 1, wherein said seat slides along an arc to adjust the position of said seat with respect to said T-shaped base.

8. The adjustable work chair in claim 1, wherein said seat is adjustably oriented depending on the relative position of said first and second arms.

9. The adjustable work chair according to claim 1, wherein said second arm comprises a gas shock to facilitate varying lengths; said attachment means being variable for connecting said first arm at a point above said T-shaped base; and said seat includes a first pad attached to said variable attachment means such that said first pad pivots.

10. The adjustable work chair in claim 9, wherein said T-shaped base further comprises at least one castor on a lower surface of said T-shaped base.

11. The adjustable work chair in claim 9, wherein said T-shaped base further comprises at least one pad attached to an upper surface of the transverse portion of said T-shaped base.

12. The adjustable work chair according to claim 1, wherein said T-shaped base defines a base plane; and said first arm is capable of being lowered to a position substantially parallel to said base plane.

13. The adjustable work chair according to claim 12, wherein said seat is adjusted from a seating position wherein said seat is disposed above said base plane and a creeping position wherein said seat lies flat on said base plane to provide a flat platform upon which user may lie.

14. The adjustable work chain according to claim 12, wherein said seat comprises a main cushion member and an auxiliary cushion member, said auxiliary cushion member expanding outward from said main cushion member to form said flat platform.

15. The adjustable work chair according to claim 12, wherein said first arm is attached to said base at a location adjacent to an intersection of said first member and said second member of said base.

16. The adjustable work chair according to claim 12, wherein said second arm is attached to said base at a connection point, said connection point being selected from a plurality of discrete locations along a long axis of said second member to vary the distance of said intersection point from said base.

17. The adjustable work chair according to claim 12, wherein said second arm comprises a gas shock attached to said base at a location along of said base, said gas shock being cantilevered on said base and adapted to adjust the relative position of said intersection point with respect to said base.

18. The adjustable work chair according to claim 12, wherein said base further comprises at least one castor on a lower surface of said base.

19. The adjustable work chair according to claim 12, wherein said base further comprises at least one kneeling pad attached to an upper surface of the base and adapted to receive the knees of a user.

20. The adjustable work chair according to claim 19, wherein said at least one kneeling pad comprises height adjustment means for adjusting a relative height of said at least one kneeling pad.

21. The adjustable work chair according to claim 12, wherein said seat pivots with respect to said base.

22. The adjustable work chair according to claim 12, wherein said seat slides along an arc to adjust the position of said seat with respect to said base.

23. The adjustable work chair according to claim 12, wherein said seat is adjustably oriented depending on the relative position of said first and second arms.

24. An adjustable work chair comprising:

a T-shaped base;

a first arm pivotally attached to said T-shaped base at an intersection between a long and transverse length of said T-shaped base; said first arm being cantilevered with respect to said T-shaped base such that said first arm may be elevated above said T-shaped base;

a second arm adjustably attached to said T-shaped Base on said long length distant from said intersection, said second arm extending above said T-shaped base and intersecting with said first arm along a length of said first arm at an intersection point above said T-shaped base;

an attachment means for connecting said first arm and said second arm above the T-shaped base; and a seat attached to said attachment means including at least one pad which is adjustably oriented relative to said T-shaped base wherein a location of the attachment of said second arm along the long length of said T-shaped base may be selected from discrete locations along the long length of said T-shaped base to vary the distance of said intersection point above said T-shaped base.

25. An adjustable work chair comprising:

a T-shaped base;

a first arm pivotally attached to said T-shaped base at an intersection between a long and transverse length of said T-shaped base; said first arm being cantilevered with respect to said T-shaped base such that said first arm may be elevated above said T-shaped base;

a second arm adjustably attached to said T-shaped Base on said long length distant from said intersection, said second arm extending above said T-shaped base and intersecting with said first arm along a length of said first arm at an intersection point above said T-shaped base;

an attachment means for connecting said first arm and said second arm above the T-shaped base; and a seat attached to said attachment means including at least one pad which is adjustably oriented relative to said T-shaped base, wherein said T-shaped base further comprises at least one kneeling pad attached to an upper surface of the transverse length of said T-shaped base and adapted to receive a knee of a user.

26. The adjustable work chair in claim 25, wherein said at least one kneeling pad comprises height adjustment means for adjusting a relative height of said at least one kneeling pad.

* * * * *